US007226160B2

(12) United States Patent
Tanaka et al.

(10) Patent No.: US 7,226,160 B2
(45) Date of Patent: Jun. 5, 2007

(54) INK JET RECORDING MEDIUM AND INK FIXER

(75) Inventors: Kanako Tanaka, Sakaide (JP); Akira Okada, Sakaide (JP)

(73) Assignee: Kyowa Chemical Industry Co., Ltd.., Kagawa (JP)

( * ) Notice: Subject to any disclaimer, the term of this patent is extended or adjusted under 35 U.S.C. 154(b) by 312 days.

(21) Appl. No.: 10/510,158

(22) PCT Filed: Apr. 28, 2003

(86) PCT No.: PCT/JP03/05451

§ 371 (c)(1),
(2), (4) Date: Oct. 5, 2004

(87) PCT Pub. No.: WO03/093022

PCT Pub. Date: Nov. 13, 2003

(65) Prior Publication Data

US 2005/0200683 A1 Sep. 15, 2005

(30) Foreign Application Priority Data

Apr. 30, 2002 (JP) ..... 2002-129073

(51) Int. Cl.
*B41J 2/01* (2006.01)

(52) U.S. Cl. ..... 347/105; 347/101; 428/32.1

(58) Field of Classification Search ..... 347/105, 347/101, 100; 428/195, 32.1
See application file for complete search history.

(56) References Cited

U.S. PATENT DOCUMENTS 6,341,560 B1 1/2002 Shah et al.

FOREIGN PATENT DOCUMENTS

JP 8-216499 8/1996
JP 9-109545 4/1997
JP 09-309265 * 12/1997
JP 9-309265 12/1997

OTHER PUBLICATIONS

Chernosky, J.V., *Carnegie Institute Yearbrook*, vol. 70, pp. 153-157 (1971).
Chernosky, *American Mineralogist*, vol. 60, pp. 200-208 (1975).
Yamai, et al., *Journal of Crystal Growth*, vol. 24/25, pp. 617-620 (1974).

* cited by examiner

*Primary Examiner*—Manish S. Shah
(74) *Attorney, Agent, or Firm*—Wenderoth, Lind & Ponack, L.L.P.

(57) ABSTRACT

An ink jet recording medium having an ink receiving layer formed on a substrate, wherein an ink fixing agent contained in the ink receiving layer is a serpentine compound containing at least one metal selected from the group consisting of Mg and Zn, and an ink fixing agent which comprises a serpentine compound containing at least one metal selected from the group consisting of Mg and Zn and is used in the ink jet recording medium.

According to the present invention, an ink jet recording medium having excellent ink absorptivity (color development, resolution) and excellent water resistance and light resistance for an image recorded on the medium can be provided by using a serpentine compound as an ink fixing agent. That is, according to the present invention, there can be provided an ink jet recording medium which is best suited for recording with a water/oil ink, can record a high-definition image at a high reproducibility and has excellent keeping properties, especially water resistance and light resistance.

16 Claims, 2 Drawing Sheets

INK JET RECORDING MEDIUM AND INK FIXER

FIELD OF THE INVENTION

The present invention relates to an ink jet recording medium for forming a recorded image with a water/oil ink and to an ink fixing agent for use in the recording medium. Particularly, it relates to an ink fixing agent for use in ink jet recording media, which is excellent in ink absorptivity (color development, resolution) and the fixing stability (water resistance and light resistance) of an image recorded on a medium and to an ink jet recording medium comprising the fixing agent in an ink receiving layer.

DESCRIPTION OF THE PRIOR ART

An image displayed on a monitor is now recorded on a recording medium like a silver salt-based photo due to the spread of personal computers, digital cameras, etc. An image forming system called "ink jet recording system" is known as a system for recording the above image. Since this ink jet recording system has various advantageous features such as little noise, high-speed recording, ease of recording multiple colors, great versatility of a recording pattern and unnecessary development and fixing steps, it is used in many fields.

The principle of ink jet recording is that an ink solution is ejected from a nozzle by an electric field, heat or pressure as a drive source and transferred to the receiving layer of a recording medium. In general, the ink solution is prepared from a dye, water, polyhydric alcohol, etc., and a water-soluble direct dye or acid dye is mainly used as the above dye.

PROBLEMS TO BE SOLVED BY THE INVENTION

However, an image formed with a dye ink for use in the ink jet recording system has been unsatisfactory in terms of keeping properties.

Therefore, use of a pigment ink which is superior in keeping properties (especially light resistance) to a dye ink is now under study. However, as the dye molecule of a dye ink is smaller than that of a pigment dye, it can permeate the inside of a receiving layer and be fixed. In contrast to this, as the pigment particles of a pigment ink hardly permeate the inside of a receiving layer, it may not be completely fixed in a recording medium. In this case, when water contacts the recording surface, the ink flows out, that is, water resistance deteriorates. Therefore, a pigment ink fixing agent which is required for an ink jet recording medium for forming a recorded image with a pigment ink needs to spread a pigment component over the surface layer portion of the receiving layer uniformly, fix and anchor it and to have a solvent for the pigment ink quickly absorbed into the inside of the receiving layer.

In general, synthetic silica which is used in an ink jet recording medium as not only a dye-containing ink fixing agent but also a pigment-containing ink fixing agent is excellent in the physical properties of pores. However, an additive such as a cationic polymer must be added excessively to fix a negatively charged pigment ink as the surface of synthetic silica is negatively charged, and the light resistance of synthetic silica is deteriorated by the cationic polymer.

MEANS FOR SOLVING THE PROBLEMS

Then, the inventors of the present invention have conducted studies for the development of an ink fixing agent which can stably fix various inks, especially a pigment ink in the ink receiving layer of an ink jet recording medium having the ink receiving layer formed on a substrate.

The inventors have paid attention to serpentine compounds having positively and negatively charged surfaces and investigated the ink absorptivities and fixing stabilities of various serpentine compounds as ink fixing agents.

As a result, they have found that the serpentine compounds are closely connected with the absorptivity and fixing stability of an ink, especially a pigment ink, that is, when a serpentine compound is used as a fixing agent, a pigment ink which is negatively charged is adsorbed to the serpentine compound and a solvent contained in the pigment ink is also quickly absorbed. Therefore, it was found that the serpentine compound has excellent pigment ink fixing stability and a high-definition image recording medium is obtained. Since the serpentine compound also shows excellent fixing properties for a dye ink, it can also be used in an ink jet recording system using a dye ink or an ink jet recording system using both dye and pigment inks.

According to the present invention, there is provided an ink jet recording medium having an ink receiving layer formed on a substrate, wherein an ink fixing agent contained in the ink receiving layer is a serpentine compound containing at least one metal selected from the group consisting of Mg and Zn.

Further, according to the present invention, there is provided an ink fixing agent for use in an ink jet recording medium having an ink receiving layer formed on a substrate, wherein the ink fixing agent contained in the ink receiving layer is a serpentine compound containing at least one metal selected from the group consisting of Mg and Zn.

The ink fixing agent and the ink jet recording medium comprising the same of the present invention will be described in more detail hereinbelow.

The serpentine compound in the present invention may be natural or synthetic but desirably synthetic from the viewpoint of homogeneity and stability for using it as a fixing agent.

In general, it is known that serpentine is ideally and chemically represented by $Mg_3Si_2O_5(OH)_4$ (or $3MgO.2SiO_2.2H_2O$). According to properties under an electron microscope, serpentine is divided into tubular (fibrous) chrysotile, lamellar lizardite and lamellar antigorite having a wavy super structure in the X-axis direction. The X-ray powder pattern of serpentine is characterized by bottom reflection at 7.2 to 7.3 Å and (060) reflection at 1.53 to 1.56 Å.

Since a synthetic serpentine compound contains water molecules between layers, it is characterized by bottom reflection at 8.5 to 10.0 Å which is wider than the range of general serpentine. Its infrared absorption spectrum is characterized by a strong OH stretching vibration band at around 3,690 $cm^{-1}$ and a lattice vibration band at 1,200 to 900 $cm^{-1}$. A synthetic serpentine compound is a laminar silicate mineral consisting of Mg—O octagonal layers and Si—O tetragonal layers in a ratio of 1:1.

Various methods for synthesizing a serpentine compound are known. Some of them are given below.

(1) "Carnegie Inst. Yearbook, 70, 153–157 (1971)" written by Chernosky, J. V.

(2) "Amer. Mineral, 60, 200–208 (1975)" written by Chernosky, J. V.

(3) "J. Chryst. Growth, 24/25, 617–620 (1974)" written by Yamai, I. and Saito, H.

These known documents are just examples. That is, a serpentine compound can be synthesized through a hydrothermal reaction of a mixture of magnesium and silica oxides. As for the reaction conditions (such as temperature, time and pH), the conditions described in the above documents may be employed or slightly changed.

Although a natural or synthetic serpentine compound may be used in the present invention, a synthetic serpentine compound is preferred from the viewpoints of homogeneity and stability of quality as a fixing agent.

The serpentine compound in the present invention may be obtained by substituting some of magnesium (Mg) atoms with zinc (Zn) atoms. That is, the serpentine compound of the present invention is preferably a compound represented by the following chemical formula (1):

$$(Mg_aZn_b)Si_2O_5(OH)_{2(a+b)-2}.nH_2O \quad (1)$$

wherein "a", "b" and "n" satisfy $2.7<a<3.5$, $0\leqq b<0.25$ and $0<n<3$, respectively.

Preferably, in the above formula (1), "a" satisfies $2.8\leqq a\leqq 3.4$, "b" satisfies $0\leqq b\leqq 0.2$, and "n" satisfies $1\leqq n<3$. It is advantageous that the (a+b) value be in the range of 2.7 to 3.5, preferably 2.8 to 3.4.

The above chemical formula (1) may be expressed as the following formula in terms of oxide composition.

$$aMgO.bZnO.2SiO_2.nH_2O$$

wherein "a" and "b" are as defined hereinabove, and "n" satisfies $2<n<5$.

Various advantages other than the above advantages can be obtained by using a synthetic serpentine compound in the present invention. That is, it can be synthesized by carrying out a hydrothermal reaction of a mixture of raw materials at a temperature of 50 to 200° C. for 1 to 24 hours and at a pH of 9 to 12 in an aqueous system. The surface of the obtained serpentine compound is positively and negatively charged and the form of its particle is not fibrous but massive.

Desirably, the serpentine compound used in the present invention has forms and properties having the following values.

It is advantageous that the serpentine compound should have a specific surface area measured by a BET method of 150 to 500 $m^2/g$, preferably 200 to 500 $m^2/g$. It is desirable that it should have a total pore volume measured by an $N_2$ gas adsorption method of 0.40 to 1.20 mL/g, preferably 0.45 to 1.20 mL/g. It is advantageous that the serpentine compound should have an average pore diameter measured by the $N_2$ gas adsorption method of 40 to 150 Å, preferably 50 to 150 Å. It is also advantageous that the serpentine compound should have an average particle diameter of 1 to 15 μm, preferably 1 to 10 μm.

It is also desirable that the serpentine compound should have a bottom reflection spacing (dÅ) measured by a powder X-ray diffraction method of 8.5 to 10.0 Å and a (060) reflection spacing (dÅ) of 1.53 to 1.56 Å.

In the infrared absorption spectrum of a more preferred serpentine compound, a strong OH stretching vibration band is observed at around 3,690 $cm^{-1}$, an absorption band caused by a hydrogen bond is observed at around 3,691 to 3,440 $cm^{-1}$, and a Si—O stretching vibration band is observed at around 1,087 to 985 $cm^{-1}$. It is advantageous that the powder of the serpentine compound should have a bulk density of 30 to 120 ml/10 g, preferably 40 to 120 ml/10 g.

DETAILED DESCRIPTION OF THE PREFERRED EMBODIMENT

Figure 1:
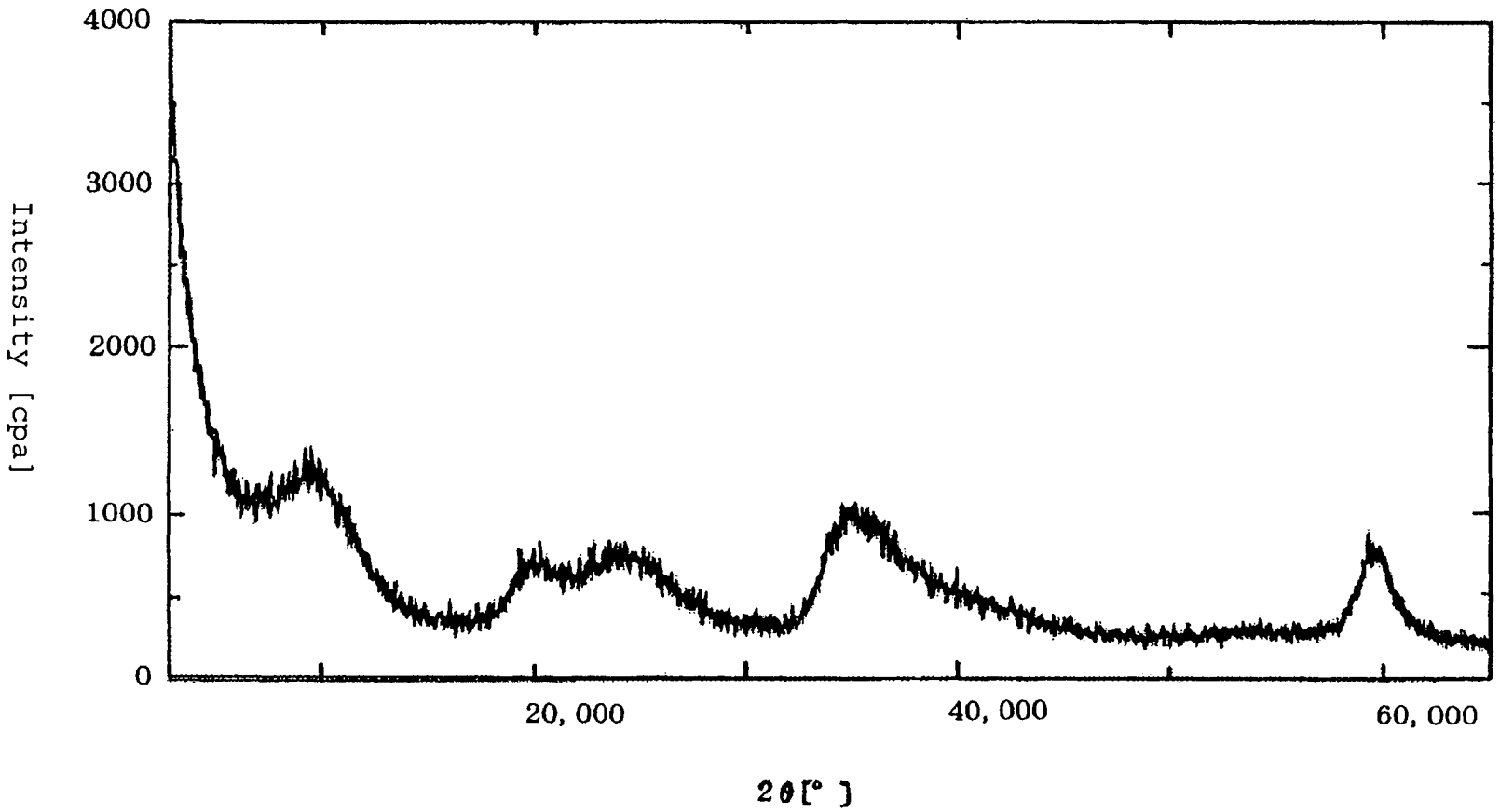
FIG. 1 shows an X-ray diffraction image of a synthetic serpentine compound which can be used in the present invention.
Figure 2:
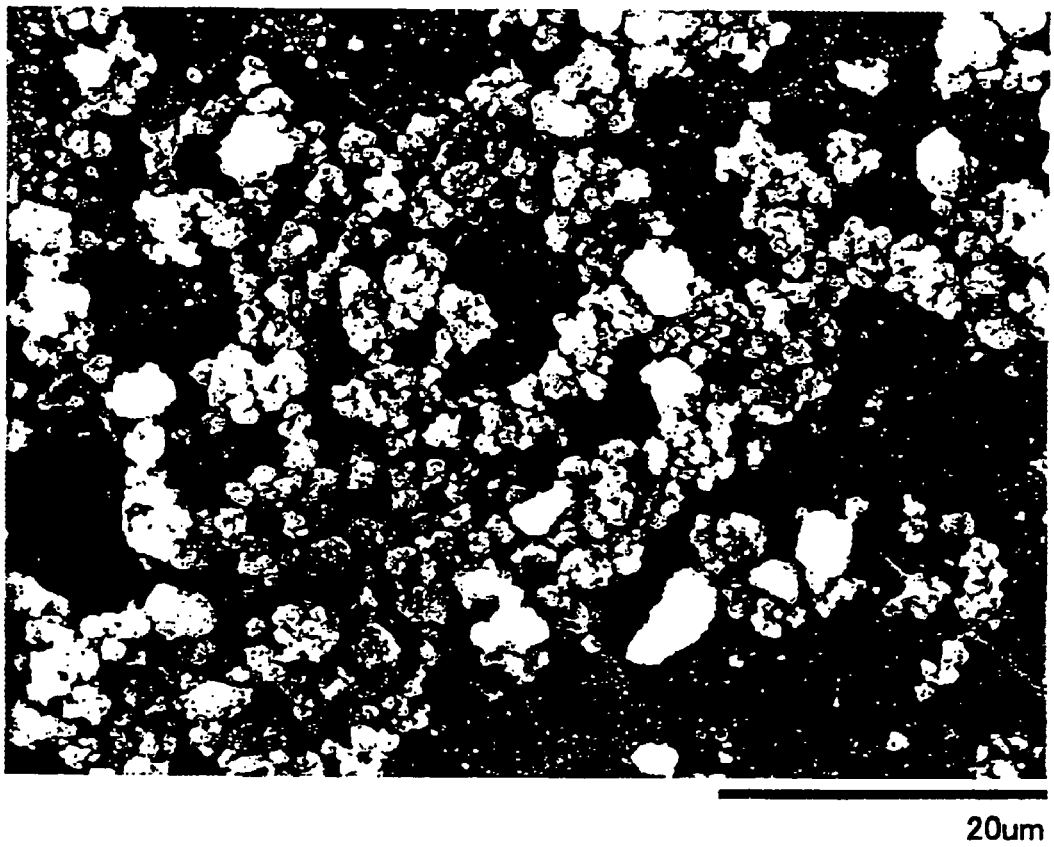
FIG. 2 shows a scanning electron microphotograph (X2,000) of a synthetic serpentine compound which can be used in the present invention.

FIG. 1 shows an X-ray diffraction image of an example of a synthetic serpentine compound of the present invention. In the diffraction image, magnesium oxide is not observed. Although the synthetic serpentine compound of the present invention can be expressed by MgO and $SiO_2$ in the oxide composition formula, it is understood that it is not a mixture of these oxides but a single compound. The same can be said when ZnO is existent in the oxide composition formula. FIG. 2 shows a scanning electron microphotograph (X2,000).

Since the synthetic serpentine compound as a pigment ink fixing agent in the present invention has all of the above advantages, adsorbed pigment particles are stabilized and an image having excellent water resistance and light resistance is obtained.

In the ink jet recording medium of the present invention, the constituents of a coating solution other than the ink fixing agent will be described hereinbelow. To form a dye or pigment ink receiving layer on a substrate, a coating solution containing a dye or pigment ink fixing agent is used. The coating solution contains a polymer adhesive, additives and solvent known per se as the main components, in addition to the ink fixing agent. The ink jet recording medium of the present invention may be composed of a single layer or multiple layers, and the corona treatment or anchor coating of the substrate may be carried out to improve adhesion. The receiving layer may be composed of a single layer or multiple layers as required.

An inorganic or organic pigment may be optionally used in the receiving layer as an aid. Examples of the pigment include inorganic pigments such as synthetic silica, colloidal silica, cationic colloidal silica, alumina sol, pseudo-boehmite gel, talc, kaolin, clay, sintered clay, zinc oxide, zinc sulfide, zinc carbonate, tin oxide, aluminum oxide, aluminum hydroxide, aluminum silicate, calcium carbonate, calcium sulfate, calcium silicate, satin white, barium sulfate, titanium dioxide, magnesium silicate, magnesium carbonate, magnesium oxide, smectite, lithopone, mica, zeolite and diatomaceous earth; and organic pigments such as styrene-based plastic pigments, acryl-based plastic pigments, microcapsule plastic pigments, urea resin-based plastic pigments, melamine resin-based plastic pigments, benzoguanamine-based plastic pigments and acrylonitrile-based plastic pigments, all of which are known in the general coated paper field. A suitable pigment may be selected from these and used.

Examples of the polymer adhesive include (a) starches such as starch, oxidized starch, etherified starch and cationized starch; (b) cellulose derivatives such as methyl cellulose, carboxymethyl cellulose, hydroxyethyl cellulose, hydroxypropyl cellulose and hydroxypropylmethyl cellulose; (c) proteins such as gelatin, casein, soybean protein and synthetic proteins; (d) natural and semi-synthetic adhesives such as agarose, guar gum, chitosan and sodium alginate; (e) polyvinyl alcohol derivatives such as polyvinyl alcohol and cationic polyvinyl alcohol and silicone-containing polyvinyl alcohol; (f) synthetic, water-soluble and solvent-soluble adhesives such as polyethyleneimine-based resins, polyvinylpyrrolidone-based resins, poly(meth)acrylic acid and copolymers thereof, maleic anhydride-based resins, acrylamide-based resins, (meth)acrylate-based resins, polyamide-based resins, polyurethane-based resins, polyester-based resins, polyvinylbutyral-based resins, alkyd resin, epoxy-based resins, epichlorohydrin-based resins, urea resin and melamine resin; (g) conjugated diene-based latices such as styrene-butadiene copolymer and methyl methacrylate-butadiene copolymer, acrylic polymer latices such as acrylate and methacrylate polymers and copolymers, vinyl-based polymer latices such as ethylene-vinyl acetate copolymer, modified polymer latices containing a functional group such as an anionic and/or cationic group(s) of these polymers, and urethane-based latices; and (h) conductive resins typified by polyvinylbenzyltrimethylammonium chloride, polydiallyldimethylammonium chloride, polymethacryloyloxyethyl-β-hydroxyethyldimethylammonium chloride and polydimethylaminoethyl methacrylate hydrochloride. These polymer adhesives known in this technical field may be used alone or in combination.

Additives may be added in limits that do not impair fixing properties. The additives include a dispersant, anti-foaming agent, thickener, ultraviolet light absorber, fluorescent brightener, antioxidant, water resisting agent, surfactant, fluidity modifier, thermal stabilizer, defoaming agent, foaming agent, adhesion promoter, pH modifier, penetrant, wetting agent, thermal gelling agent, lubricant, colorant, antiseptic agent, mildewproofing agent, antistatic agent and crosslinking agent, all of which have been conventionally known and are commonly used.

Examples of the solvent for the coating solution include lower alcohols such as methyl alcohol, ethyl alcohol and propyl alcohol; glycols such as ethylene glycol, diethylene glycol, triethylene glycol and dioxane; lower alkyl esters such as methyl acetate and ethyl acetate; water-soluble organic solvents such as acetonitrile and dimethyl acetamide; and water. They may be used alone or as a mixed solvent of two or more.

High-quality paper, medium-quality paper, coated paper, artificial paper, cast coated paper, paper board, synthetic resin laminated paper, metal deposited paper, synthetic paper, or white film is used as the substrate for a recording medium which does not need to transmit light and a sheet of glass or OHP sheet such as a film of polyethylene terephthalate, polyester, polystyrene, polyvinyl chloride, polymethyl methacrylate, polycarbonate, polyimide, cellulose triacetate, cellulose diacetate, polyethylene or polypropylene is used as the substrate for a light transmitting recording medium.

The amount of the ink fixing agent is 10 to 90 wt %, preferably 15 to 90 wt % of the solids content (ink fixing agent, polymer adhesive, solid additives, inorganic or organic pigment, etc.) of the receiving layer. When the amount of the ink fixing agent is too large, a receiving layer which lacks flexibility is obtained and when the amount is too small, ink fixing properties deteriorate.

Although the method and means for forming the ink receiving layer are not particularly limited, a suitable method may be employed according to the material of the substrate. For example, the most commonly used coating means such as bar coater, roll coater, air knife coater, blade coater, rod blade coater, brush coater, curtain coater, gravure coater, flexographic coater, cast coater, die coater, lip coater, size press or spray device may be used.

Besides the above method of obtaining a recording medium by forming an ink receiving layer on the substrate, a recording medium whose ink receiving layer and substrate are integrated, such as paper or pulp, is obtained by holding an ink fixing agent between intertwined fibers. An excellent recorded image forming material can be obtained by containing the ink fixing agent of the present invention in the substrate including the surface.

A coating solution is prepared from the above ink fixing agent, polymer adhesive, additives, inorganic or organic dye or pigment and solvent.

EXAMPLES

The following examples are given to further illustrate the present invention.

Physical properties in the following examples were measured and evaluated as follows.

(1) The BET specific surface area ($m^2/g$), total pore volume (mL/g) and average pore diameter (Å) of the synthetic serpentine compound (particles) were obtained from the adsorption and desorption of $N_2$ gas with the NOVA 2000 gas adsorption device of Quantachrome Co., Ltd. after a specimen was held at 110° C. and 1.3 Pa or less for 3 hours as a pre-treatment. The total pore volume is the amount of adsorbed gas at a relative pressure $P/P_0 \approx 1$, and the average pore diameter is a value obtained based on the assumption that the pore structure is cylindrical.

(2) The average particle diameter (μm) of the synthetic serpentine compound (particles) was obtained by the LA-910 laser diffraction/scattering particle size distribution measuring instrument of HORIBA Co., Ltd.

(3) The unit layer interval (dÅ) of the synthetic serpentine compound (particles) was obtained by the RINT 2200V X-ray diffraction device of Rigaku Co., Ltd.

Example 1

0.6 liter of deionized water was injected into a 1-liter vessel, and 16.55 g of magnesium oxide (commercially available product, content of 97%, BET specific surface area of 6.8 $m^2/g$) and 17.71 g of synthetic amorphous silica (commercially available under the trade name of Tokusil UR, content of 94.86%) were added under agitation with a homomixer. After about 20 minutes of agitation, a hydrothermal reaction of the resulting suspension was carried out at 170° C. for 10 hours. After cooling, the suspension was filtered and washed (pH of the suspension was 10.63 (22.5° C.)). After washing, it was dried at 95° C. for 20 hours. After drying, it was put through a 100-mesh sieve. The yield of the dried product was 38.8 g. The compound obtained by the above method was a serpentine compound represented by the following chemical formula. The X-ray diffraction diagram of this synthetic serpentine compound is shown in FIG. 1, its scanning electron microphotograph is shown in FIG. 2, and its physical properties are shown in Table 1.

$$Mg_{3.03}Si_2O_5(OH)_{4.06}.1.87H_2O$$

Example 2

0.6 liter of deionized water was injected into a 1-liter vessel, and 14.85 g of magnesium oxide (commercially available product, content of 97%, BET specific surface area of 6.8 $m^2/g$) and 25.85 g of magnesium silicate (commercially available under the trade name of KW-600 BUP-S, MgO content of 14.5%, $SiO_2$ content of 65.0%) were added under agitation with a homomixer. After about 20 minutes of agitation, a hydrothermal reaction of the resulting suspension was carried out at 170° C. for 10 hours. After cooling, the suspension was filtered and washed (pH of the suspension was 11.90 (25.3° C.)). After washing, it was dried at 95° C. for 20 hours. After drying, it was put through a 100-mesh sieve. The yield of the dried product was 41.2 g. The compound obtained by the above method was a serpentine compound represented by the following chemical formula. The physical properties of this synthetic serpentine compound are shown in Table 1.

$$Mg_{3.1}Si_2O_5(OH)_{4.2}.1.9H_2O$$

Example 3

0.6 liter of deionized water was injected into a 1-liter vessel, and 15.11 g of magnesium oxide (commercially available product, content of 97%, BET specific surface area of 6.8 $m^2/g$), 13.53 g of magnesium silicate (commercially available product under the trade name of KW-600, MgO content of 13.9%, $SiO_2$ content of 62.1%) and 8.84 g of synthetic amorphous silica (commercially available under the trade name of Carplex #80, content of 88.28%) were added under agitation with a homomixer. After about 20 minutes of agitation, a hydrothermal reaction of the resulting suspension was carried out at 170° C. for 10 hours. After cooling, the suspension was filtered and washed (pH of the suspension was 11.09 (25.6° C.)). After washing, it was dried at 95° C. for 20 hours. After drying, it was put through a 100-mesh sieve. The yield of the dried product was 39.8 g. The compound obtained by the above method was a serpentine compound represented by the following chemical formula. The physical properties of this synthetic serpentine compound are shown in Table 1.

$$Mg_{2.93}Si_2O_5(OH)_{3.86}.1.97H_2O$$

Example 4

0.6 liter of deionized water was injected into a 1-liter vessel, and 13.26 g of magnesium oxide (commercially available product, content of 97%, BET specific surface area of 6.8 $m^2/g$), 25.0 g of magnesium silicate (commercially available under the trade name of KW-600 BUP-S, MgO content of 14.7%, $SiO_2$ content of 67.2%) and 1.37 g of zinc oxide (commercially available product, BET specific surface area of 3.5 $m^2/g$) were added under agitation with a homomixer. After about 20 minutes of agitation, a hydrothermal reaction of the resulting suspension was carried out at 170° C. for 10 hours. After cooling, the suspension was filtered and washed (pH of the suspension was 11.79 (25.7° C.)). After washing, it was dried at 95° C. for 20 hours. After drying, it was put through a 100-mesh sieve. The yield of the dried product was 40.7 g. The compound obtained by the above method was a serpentine compound represented by the following chemical formula. The physical properties of this synthetic serpentine compound are shown in Table 1.

$$Mg_{2.81}Zn_{0.12}Si_2O_5(OH)_{3.86}.1.22H_2O$$

Comparative Example 1

The physical properties of commercially available synthetic silica (trade name: Finesil, manufactured by Tokuyama Corporation) are shown in Table 1.

Examples 5 to 8 and Comparative Examples 2 and 3 (Evaluation of Ink Jet Recording Media)

Preparation of Ink Jet Recording Media

Ink jet recording media were prepared from the above serpentine compounds of Examples 1 to 4 and Comparative Example 1 (synthetic silica) in accordance with the following method.

40 parts by weight of polyvinyl alcohol as a polymer adhesive was added to and mixed with 100 parts by weight of the synthetic serpentine compound or synthetic silica to obtain a coating solution having a solids content of 18 to 20 wt %. This coating solution was applied to paper with No.20 bar coater and dried to obtain ink jet recording media.

Ink Jet Printing

Printing was made on the obtained ink jet recording media by an ink jet recording device (trade name: MC-2000, manufactured by Epson Co., Ltd.).

Evaluation of Printing Properties

Ink absorptivity (color development, resolution), water resistance and light resistance were evaluated in accordance with the following methods.

(1) Ink Absorptivity (Color Development, Resolution)

A full-color image formed on a printing sheet was observed with the eye. The ink absorptivity was evaluated based on the following criteria.

○: all the colors are strong and clear.

Δ: there is a weak color.

X: all the colors are weak and not clear.

(2) Water Resistance

The printed surface was immersed in water for 1 minute and dried to check the flowing or bleeding of ink.

○: ink on a printed portion neither flows out nor bleeds at all.

Δ: ink on a printed portion slightly flows out but there is substantially no problem.

X: ink on a printed portion flows out and bleeds.

(3) Light Resistance

Solid printing of cyan (C), magenta (M), yellow (Y) and black (B) colors was carried out, and these printed colors were exposed to light with a Sunshine weatherometer (WEL-SUN-HC-B of Suga Shikenki Co., Ltd.) until the grade 6 blue scale was discolored as a reference and measured with a color difference meter (ZE-2000 of Nippon Denshoku Co., Ltd.) to evaluate the light resistance. The evaluation was made based on the ΔE value.

○: $0 \leqq \Delta E \leqq 2$

Δ: $2 < \Delta E \leqq 5$

X: $\Delta E > 5$

Evaluation Results of Printing Properties

The evaluation results of printing properties are shown in Table 2 below. In Comparative Example 3, commercially available ink jet paper (MC mat paper; Epson Co., Ltd.) was used.

TABLE 1

| | average particle diameter (μm) | BET ($m^2/g$) | total pore volume | average pore diameter | unit layer interval: bottom reflection dÅ | unit layer interval: (60) reflection dÅ | unit layer interval: bulk[1)] |
|---|---|---|---|---|---|---|---|
| Ex. 1 | 4.39 | 370 | 0.6072 | 65.70 | 9.213 | 1.551 | 55 |
| Ex. 2 | 7.91 | 318 | 0.4327 | 54.43 | 9.017 | 1.548 | 41 |

TABLE 1-continued

| | average particle diameter (μm) | BET ($m^2/g$) | total pore volume | average pore diameter | unit layer interval bottom reflection dÅ | unit layer interval (60) reflection dÅ | bulk[1)] |
|---|---|---|---|---|---|---|---|
| Ex. 3 | 4.79 | 357 | 0.5242 | 58.80 | 9.205 | 1.549 | 45 |
| Ex. 4 | 8.50 | 342 | 0.4963 | 57.98 | 9.297 | 1.549 | 49 |
| C. Ex. 1 | 10.9 | 290 | 0.9355 | 128.7 | — | — | 102 |

Ex.: Example
C. Ex.: Comparative Example

Bulk Measurement; Bulk measurement; 10 g of a sample was injected into a 100 ml graduated cylinder to measure its bulk (ml/10 g).

TABLE 2

| | pigment ink fixing agent | ink absorptivity | water resistance | light resistance Y | M | C | B |
|---|---|---|---|---|---|---|---|
| Ex. 5 | Ex. 1 | ○ | ○ | ○ | ○ | ○ | ○ |
| Ex. 6 | Ex. 2 | ○ | ○ | ○ | ○ | ○ | ○ |
| Ex. 7 | Ex. 3 | ○ | ○ | ○ | Δ | ○ | Δ |
| Ex. 8 | Ex. 4 | ○ | ○ | ○ | Δ | ○ | ○ |
| C. Ex. 2 | C. Ex. 1 | Δ | X | ○ | Δ | ○ | ○ |
| C. Ex. 3 | — | ○ | ○ | ○ | X | Δ | Δ |

Ex: Example
C. Ex.: Comparative Example

Examples 9 to 12 and Comparative Example 4

Printing properties were evaluated in the same manner as in Examples 5 to 8 and Comparative Example 2 except that an ink jet recording device loaded with a dye ink (PM-820C of Epson Co., Ltd.) was used in place of the ink jet recording device loaded with a pigment ink (MC-2000 of Epson Co., Ltd.). As a result, evaluations of Example 9 to 12 and Comparative Example 4 are obtained the same results as those of Example 5, Example 6, Example 7, Example 8 and Comparative Example 2, respectively.

EFFECT OF THE INVENTION

According to the present invention, an ink jet recording medium having excellent ink absorptivitiy (color development, resolution) and excellent water resistance and light resistance for an image recorded on the medium can be provided by using a serpentine compound as an ink fixing agent. That is, according to the present invention, there can be provided an ink jet recording medium which is best suited for recording with a water/oil ink, can record a high-definition image at a high reproducibility and has excellent keeping properties, especially water resistance and light resistance.

The invention claimed is:

1. An ink jet recording medium having an ink receiving layer formed on a substrate, wherein an ink fixing agent contained in the ink receiving layer is a serpentine compound containing at least one metal selected from the group consisting of Mg and Zn, and wherein the serpentine compound is represented by the following formula (1):

$$(Mg_aZn_b)Si_2O_5(OH)_{2(a+b)-2}.nH_2O \quad (1):$$

wherein "a", "b" and "n" satisfy $2.7<a<3.5$, $0\leqq b<0.25$ and $0<n<3$, respectively and has a bottom reflection spacing (dÅ) measured by a power X-ray diffraction method of 8.5 to 10.0 Å and a (060) reflection spacing (dÅ) of 1.53 to 1.56 Å.

2. The ink jet recording medium according to claim 1, wherein the serpentine compound has a BET specific surface area of 150 to 500 $m^2/g$.

3. The ink jet recording medium according to claim 1, wherein the serpentine compound has a total pore volume ($N_2$ gas adsorption method) of 0.40 to 1.20 mL/g.

4. The ink jet recording medium according to claim 1, wherein the serpentine compound has an average pore diameter ($N_2$ gas adsorption method) of 40 to 150 Å.

5. The ink jet recording medium according to claim 1, wherein the serpentine compound has an average particle diameter of 1 to 15 μm.

6. The ink jet recording medium according to claim 1, wherein the serpentine compound is synthetic.

7. The ink jet recording medium according to claim 1, wherein the ink fixing agent is a fixing agent for a pigment- or dye-containing ink.

8. The ink jet recording medium according to claim 1, wherein the ink fixing agent is a fixing agent for a pigment-containing ink.

9. An ink fixing agent for use in an ink jet recording medium having an ink receiving layer formed on a substrate, which is contained in the ink receiving layer and a serpentine compound containing at least one metal selected from the group consisting of Mg and Zn, and wherein the serpentine compound is represented by the following formula (1):

$$(Mg_aZn_b)Si_2O_5(OH)_{2(a+b)-2}.nH_2O \quad (1)$$

wherein "a", "b" and "n" satisfy $2.7<a<3.5$, $0\leqq b<0.25$ and $0<n<3$, respectively and has a bottom reflection spaciun measured by a power X-ray diffraction method (dÅ) of 8.5 to 10.0 Å and a (060) reflection spacing (dÅ) of 1.53 to 1.56 Å.

10. The ink fixing agent according to claim 9 wherein the serpentine compound has a BET specific surface area of 150 to 500 $m^2/g$.

11. The ink fixing agent according to claim 9 wherein the serpentine compound has a total pore volume ($N_2$ gas adsorption method) of 0.40 to 1.20 mL/g.

12. The ink fixing agent according to claim 9 wherein the serpentine compound has an average pore diameter ($N_2$ gas adsorption method) of 40 to 150 Å.

13. The ink fixing agent according to claim 9 wherein the serpentine compound has an average particle diameter of 1 to 15 μm.

14. The ink fixing agent according to claim 9 wherein the serpentine compound is synthetic.

15. The ink fixing agent according to claim 9 which is a fixing agent for a pigment- or dye-containing ink.

16. The ink fixing agent according to claim 9 which is a fixing agent for a pigment-containing ink.

* * * * *